US009003840B2

(12) United States Patent
Pillot et al.

(10) Patent No.: US 9,003,840 B2
(45) Date of Patent: Apr. 14, 2015

(54) PORTHOLE WINDOW FOR LAUNDRY WASHING AND/OR DRYING APPLIANCE

(75) Inventors: Sergio Pillot, Pasiano di Pordenone (IT); Luciano Sartor, Conegliano (IT)

(73) Assignee: Electrolux Home Products Corporation N.V., Brussels (BE)

( * ) Notice: Subject to any disclaimer, the term of this patent is extended or adjusted under 35 U.S.C. 154(b) by 890 days.

(21) Appl. No.: 13/176,128

(22) Filed: Jul. 5, 2011

(65) Prior Publication Data

US 2012/0007482 A1 Jan. 12, 2012

(30) Foreign Application Priority Data

Jul. 6, 2010 (EP) ..... 10168568

(51) Int. Cl.
*D06F 37/28* (2006.01)
*D06F 39/14* (2006.01)

(52) U.S. Cl.
CPC ..... *D06F 37/28* (2013.01); *D06F 39/14* (2013.01)

(58) Field of Classification Search
CPC ..... D06F 39/14; D06F 49/003; D06F 58/04; D06F 37/28
USPC ..... 68/196
See application file for complete search history.

(56) References Cited

U.S. PATENT DOCUMENTS

| | | | | |
|---|---|---|---|---|
| 2007/0051012 | A1* | 3/2007 | Schoene | 34/603 |
| 2009/0064593 | A1* | 3/2009 | Ha | 49/400 |
| 2011/0023561 | A1* | 2/2011 | Murrell et al. | 68/212 |
| 2011/0025178 | A1* | 2/2011 | Schone | 312/228 |

FOREIGN PATENT DOCUMENTS

| | | |
|---|---|---|
| DE | 195 15 040 | 10/1996 |
| EP | 1 297 210 | 4/2003 |
| EP | 1 367 169 | 12/2003 |
| EP | 1 899 524 | 8/2009 |
| GB | 2 008 624 | 6/1979 |

OTHER PUBLICATIONS

Extended European Search Report issued in European Application No. 10168568.3 on Dec. 16, 2010.

* cited by examiner

*Primary Examiner* — Michael Barr
*Assistant Examiner* — Spencer Bell
(74) *Attorney, Agent, or Firm* — Banner & Witcoff, Ltd.

(57) ABSTRACT

A door (125, 125', 125") for a laundry washing and/or drying appliance (100) includes a door inner frame (205, 205', 205"), a door outer frame (210, 210', 210"), and a transparent porthole window (150) having a border portion (225) fitted between the inner frame and the outer frame. In the solution according to one or more embodiments of the present invention, the border portion of the porthole window has at least one receiving region (230) having, at least on one side thereof facing the inner frame or the outer frame, a seat (235); at least the inner frame or the outer frame has, in a portion (240, 250) corresponding to the receiving region (230) of the porthole window, at least one rib (245, 255) fitting into the seat (235) of the receiving region (230).

13 Claims, 11 Drawing Sheets

PORTHOLE WINDOW FOR LAUNDRY WASHING AND/OR DRYING APPLIANCE

CROSS-REFERENCE TO RELATED APPLICATION

This application claims priority to European Application No. 10168568.3 filed on Jul. 6, 2010.

BACKGROUND OF THE INVENTION

1. Field of the Invention

The present invention generally relates to the field of household appliances. More specifically, the present invention relates to the field of doors for household appliances. Even more specifically, the present invention relates to a porthole window for a front-loading drum-type laundry washing and/or drying appliance, such as a laundry washer or washer/dryer, a dry-cleaning laundry washer, a laundry dryer.

2. Overview of the Related Art

A generic front-loading laundry washing and/or drying appliance, such as a laundry washer or a dry-cleaning laundry washer, designed to wash laundry (for example, clothing, towels and sheets) by using water as primary cleaning solution or by using other cleaning solutions, respectively, or a laundry dryer, typically has a housing casing and an access door on the front side of the housing casing for inserting the laundry within a rotating drum inside the appliance. In the following, for the sake of exposition brevity, general reference will be made to a washing/drying machine (i.e., a washing and/or drying machine), but it is not to be understood in a limitative way.

In conventional washing/drying machines, the door, typically having a circular shape, has a circular porthole window and at least two circular frame elements fitting the porthole window therebetween. For aesthetical and practical reasons, the frame elements may be made of the same material as the housing casing, typically of lightweight materials (such as plastics or aluminium or a combination thereof), while the porthole window is usually made of high heat endurance transparent material (for example, glass), so as to allow a user to see the interior of the washing/drying machine during the operation thereof (for checking that the right washing/drying cycle is taking place regularly), without that such transparent material melts because of the relatively high temperatures to which the washing/drying machine is subject during its operation.

When the door is opened, the laundry to be washed can be loaded directly into the rotating drum and the washed/dried laundry can be removed therefrom. It is customary, for front-loading drum-type washing/drying machines, to use glass porthole windows that are of a bowl-like shape, extending inwards in the direction of the rotating drum when the door is in the closed configuration, so that in such configuration the glass porthole window fills the region between the housing casing and the rotating drum containing the laundry; in this way, a dead space between the outer casing of the washing/drying machine and the rotating drum is avoided, but at the cost of a more complex shape for the glass porthole window, and of a significantly increase in glass volume request for implementing the specific shape.

Such implementation for the washing/drying machines door exhibits critical aspects that may impair endurance and reliability characteristics thereof. In general, because of the increase in glass volume needed for making the glass porthole window, the washing/drying machine door exhibits an excessive weight with respect to the weight of most of the other components forming it (for example, the frames and a door hinge); this implies that the washing/drying machine door may be damaged relatively fast. In particular, a risk exists that the glass porthole window, because of its own weight, slightly slides from the aligned position between the frames elements towards an unwanted mismatched position.

Such mismatched position of the glass porthole window may cause substantially two kinds of drawbacks; firstly, in such condition the glass porthole window is no more able to cover precisely the dead space between the outer casing of the washing/drying machine and the rotating drum, thereby allowing water and/or detergent leakages or laundry snagging therein during the operation of the washing/drying machine.

Moreover, such mismatched position typically causes a weight re-distribution of the washing/drying machine door, thereby involving corresponding dangerous re-distributions of the force components acting on the hinge of the door, which may finally cause a break thereof.

In the state of the art, solutions are known for improving endurance and reliability characteristics of the washing/drying machines doors. For example, the document DE 195 15 040 discloses a door having a porthole window for front-loading washing machines.

The solution disclosed in such document substantially consists of an assembly consisting of a rear fixing means, glass porthole, glass porthole cover, outer frame. In particular, the glass porthole and the glass porthole cover are pressed between the outer frame and the fixing means, and are spaced apart by an elastic nose portion that is compressed under the exerted pressure. A maximum compression of the nose portion defines a distance at which the glass porthole and the glass porthole cover should be kept, in principle.

Such assembly firstly exhibits an intrinsic limitation that makes such solution not suitable in most of modern washing machines or other household or industrial appliances. In fact, the need of using the glass porthole cover (intended to prevent a user from coming into direct contact with the glass porthole, which may reach relatively high temperatures during the operation of the washing machine) as a further fixing element (in this case, a front fixing element), in addition to the provision of the rear fixing element and the frames, implies making the door assembly of the washing machine heavier, which in turn may causes hinge subsidence even in a relatively short period of use thereof.

Moreover, as it can be understood, the door shown and described in such document may suffer of the same above-mentioned drawback of misalignments of the glass porthole; in particular, although such solution provides a certain degree of stability, it results in an unsatisfactory operation condition of the washing machine. In particular, while in an off condition of the washing machine, i.e., no washing cycle is taking place for laundry cleaning, the assembly is quite effective, when the washing machine is operating the coupling is greatly reduced, thereby involving possible sliding and misalignments between the porthole window and the frames, and hence a break of the door in the same way as the known solutions, including the solution of the cited document. In fact, because of the inevitable vibrations occurring during operation of the washing machine (due, for example, to the high-speed rotary motion of the rotating drum, the water injection for cleaning the laundry or the discharging of the water-detergent mixture deriving from the rinse of the laundry), the compressed nose portion is subject to possible transversal compressions and decompressions that can make the door assembly quite less effective, thereby letting up on the nose portion and therefore causing longitudinal sliding or glass cracks of the glass porthole. For such reason, the solution disclosed in the cited document does not allow obtaining high performance doors for washing machine.

SUMMARY OF SELECTED INVENTIVE ASPECTS

In view of the state of the art outlined in the foregoing, it is a main object of the present invention to overcome the above-mentioned drawbacks of the cited prior art; in particular, the Applicants understood that there is a need of a door having a glass porthole window firmly fixed between the frames.

The present invention relates to a door for a laundry washing and/or drying appliance. In an aspect, the door includes a door inner frame, a door outer frame, and a transparent porthole window having a border portion fitted between the inner frame and the outer frame. In the solution according to one or more embodiments of the present invention, the border portion of the porthole window has at least one receiving region having, at least on one side thereof facing the inner frame or the outer frame, a seat; at least the inner frame or the outer frame has, in a portion corresponding to the receiving region of the porthole window, at least one rib fitting into the seat of the receiving region.

Advantageously, at least the inner frame or the outer frame includes at least one inner portion or outer portion, respectively, for matching the at least one receiving region, and wherein the at least one rib is provided within said at least one inner portion and/or outer portion. Preferably, the at least one inner portion comprises a plurality of corresponding ribs and the at least one outer portion comprises a plurality of corresponding ribs; the ribs of the at least one inner portion are configured to engage a rear seat of the at least one receiving region, and the ribs of the at least one outer portion are configured to engage a front seat of the receiving region.

The door may include at least one insert configured to be fitted between the inner frame and the porthole window in correspondence of at least a part of the border portion; the at least one insert may comprise at least one matching portion so as to match the at least one receiving region between the at least one matching portion and the corresponding at least one inner portion. Such at least one insert further may include threaded holes arranged at the sides of the at least one matching portion so as to perform said fitting of the at least one insert with the inner frame by a screwing operation.

The matching portion and/or the at least one inner portion include/includes corresponding ribs for holding the seat of the at least one receiving region.

Advantageously, the insert may include a counter-hinge for enabling a hinging of an assembly of the inner frame-porthole window-insert so as to increase the stability and the life-time of a hinge of the door.

Preferably, but not necessarily, the porthole window is a bowl-like porthole window extending inwards towards the interior of the appliance when the door is in a closed configuration.

The porthole window is for example made of glass, while at least part of the inner frame or the outer frame may include a composite thermoplastic material such as glass-filled nylon or a plastic compound such as glass-filled poly-propylene or talc-filled poly-propylene. Furthermore, the at least one insert, if provided, includes a composite material such as glass-filled nylon.

Preferably, but not necessarily, the at least one receiving region includes at least one wing protruding from the border portion of the glass porthole window.

Another aspect of the solution according to embodiments of the present invention relates to a front-loading drum-type laundry drying appliance (or a laundry washing machine) characterized by comprising such a door.

Thanks to the present invention, it is possible to provide laundry washer and or dryer appliances having a very high-performance fixing of the glass porthole window to the frames, and ultimately a greatly improved reliability of the door. In particular, the present invention allows ensuring a long life time of the door, and thus of the appliance, also in case of extremely intensive use thereof: this makes the solution according to the proposed invention particularly suitable for both industrial application and household applications (such as laundry washing machines, dryers, and the like). In particular, the vibration affecting the whole washing/drying machine during the operation thereof no longer causes longitudinal sliding of the glass porthole between the frames, nor transversal vibrations generating glass cracks or breaks of the glass porthole window. Finally, a good fixing of the glass porthole window ensures a greatly improved safety operation condition for the user of the washing/drying machine.

BRIEF DESCRIPTION OF THE DRAWINGS

Further details are provided in the following description of some exemplary embodiments of the invention, with reference to the attached figures, wherein.

DETAILED DESCRIPTION OF EXAMPLE EMBODIMENTS

Figure 1:
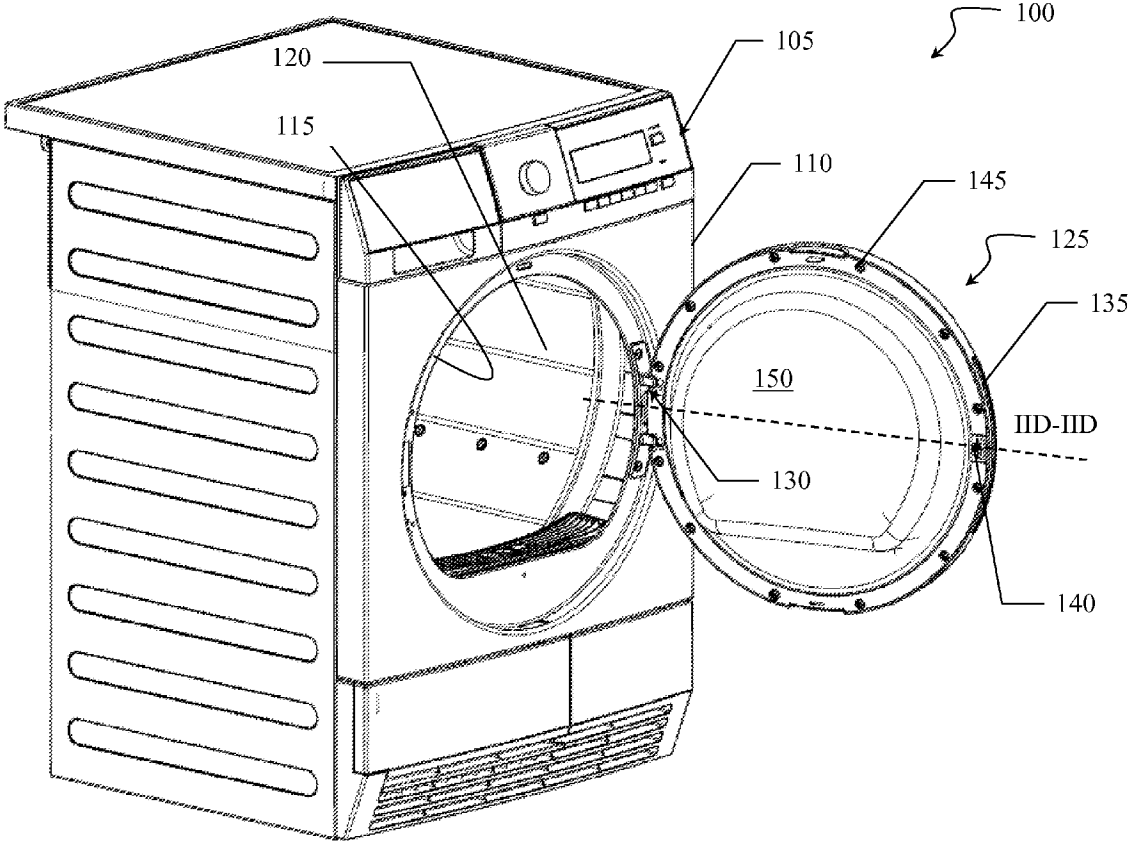
FIG. 1 is a perspective view of a drying machine according to an embodiment of the present invention with a door in an opened position.

With reference to the figures, in FIG. 1 there is shown a perspective view of a drying machine 100 according to an embodiment of the present invention. The drying machine 100 includes an outer casing 105, typically made of plastic materials, metal or a combination thereof; a front surface 110 of the outer casing 105 includes a circular opening 115 for accessing a rotating drum 120 inside the drying machine and loading the laundry to be dried or unloading the dried laundry. A circular door 125, shown in the figure in an opened configuration, is provided for opening and closing the circular opening 115; to such purpose, the door 125 includes on a side thereof a door hinge 130 for hinging the door 125 to a suitable portion of the circular opening 115, and on the opposite side an opening group including a handle 135 and a hook 140, controlled by the handle 135, for blocking the door 125 in the closed configuration and unblocking it for enabling the door opening so as to make freely accessible the circular opening 115. The door 125 further includes an annular frame 145 surrounding a transparent circular glass porthole window 150, which allows a user to see the interior of the drying machine 100 during the operation thereof and visually check a correct operation of the implemented desired program set by the user. The glass porthole window 150 is, as usual in most of washing/drying machines doors, of a bowl-like shape, extending inwards, towards the rotating drum 120 when the door 125 is closed; in such a way, the inwards extension of the bowl-like shaped porthole 150 fills the region between the housing casing 105 and the rotating drum 120 containing the laundry to be dried, thereby avoiding any dead space between the housing casing 105 and the rotating drum 120 during the operation of the drying machine 100.

A more detailed view of the door 125 according to an embodiment of the present invention is visible in a perspective exploded view in FIG. 2A (in the following, for all the figures, same or corresponding elements are denoted with equal or similar references, and their explanation is not repeated for the sake of exposition brevity). With reference to such figure, the annular frame 145 of the door 125 includes an annular inner frame 205 and an annular outer frame 210, which are intended to be fixed or coupled to each other in a known manner—for example, by a snap-fit engagement or/and by suitable screws passing through corresponding holes (as will be further detailed in the following).

Preferably, although not strictly necessarily, the inner frame 205 is made of glass-filled nylon, i.e., a composite thermoplastic material comprising nylon and reinforcing glass fibres (typically, 25% of glass fibres) and having a density higher than pure nylon and a heat resistance comparable to that of metals. Alternatively, the inner frame 205 may be made of poly-propylene, i.e. a plastic compound having a high ultimate strength, a low density, a good thermal resistance and a good resistance to abrasions, possibly glass-filled poly-propylene or talc-filled poly-propylene, which may be obtained through any known technique, for example injection moulding or extrusion.

The outer frame 210 may be formed in plastic materials, metal or a combination thereof, and the external surface (visible by the user) of the outer frame 210 is preferably shaped and coloured according to aesthetic requirements of the door 125 of the drying machine. In alternative, the outer frame 210 may be formed of glass-filled nylon or other composite thermoplastic materials.

As illustrated in the figure, the glass porthole window 150 further includes a border portion 225, which, according to an embodiment of the present invention, comprises a plurality of receiving regions 230 (four, in the exemplary shown embodiment, but the number thereof is not to be understood as limitative); such receiving regions, in the disclosed exemplary embodiment, are in the form of wings 230 protruding outwards of the external perimeter of the border portion 225 and having, as exemplary shown, a substantially trapezoidal shape. In a substantially central area of each wing 230 there is provided a seat 235 at least on one side thereof, preferably on both sides thereof, for allowing a correct and effective matching or coupling of the glass porthole window 150 between the inner frame 205 and the outer frame 210 (as will be further described shortly). Such seats 235 are formed in the thickness of the material of the border portion 225, preferably as stubbing or notch or undercut or cavity or orifice formed, during the moulding operation of the glass porthole window 150, on each wing 230 (or even of other sectors of the border portion 225, for example if the wings 230 are not provided, or reduced, for specific practical reasons).

Preferably, though not necessarily, the wings 230 (and the seats 235) are formed such as to be arranged symmetrically along the border portion 225 with respect to a median plane of the window 150 (in the shown example, two wings 230 are arranged on the left of the border portion 225 where there is the door hinge 130, while the other two wings 230 are arranged on the right of the border portion 225, where there is the opening group 135, 140); thanks to this symmetrical arrangement of the wings 230, the assembling phase providing for the coupling of the glass porthole window 150 (as will be described shortly) with the inner frame 205 and the outer frame 210 has no preferential mounting orientation.

The wings 230 are configured to match corresponding portions 240 of the inner frame 205, for example of substantially trapezoidal shape too, each portion 240 including a plurality (for example, three) of retaining ribs 245; such retaining ribs 245 are adapted to engage the rear-side seats 235 of the wings 230 of the border portion 225 when the glass porthole window 150 is mounted to the inner frame 205. Preferably, the retaining ribs 245 are formed according to a predefined arrangement (for example, a comb arrangement, with a predetermined distance between each adjacent retaining rib).

Figure 2A:
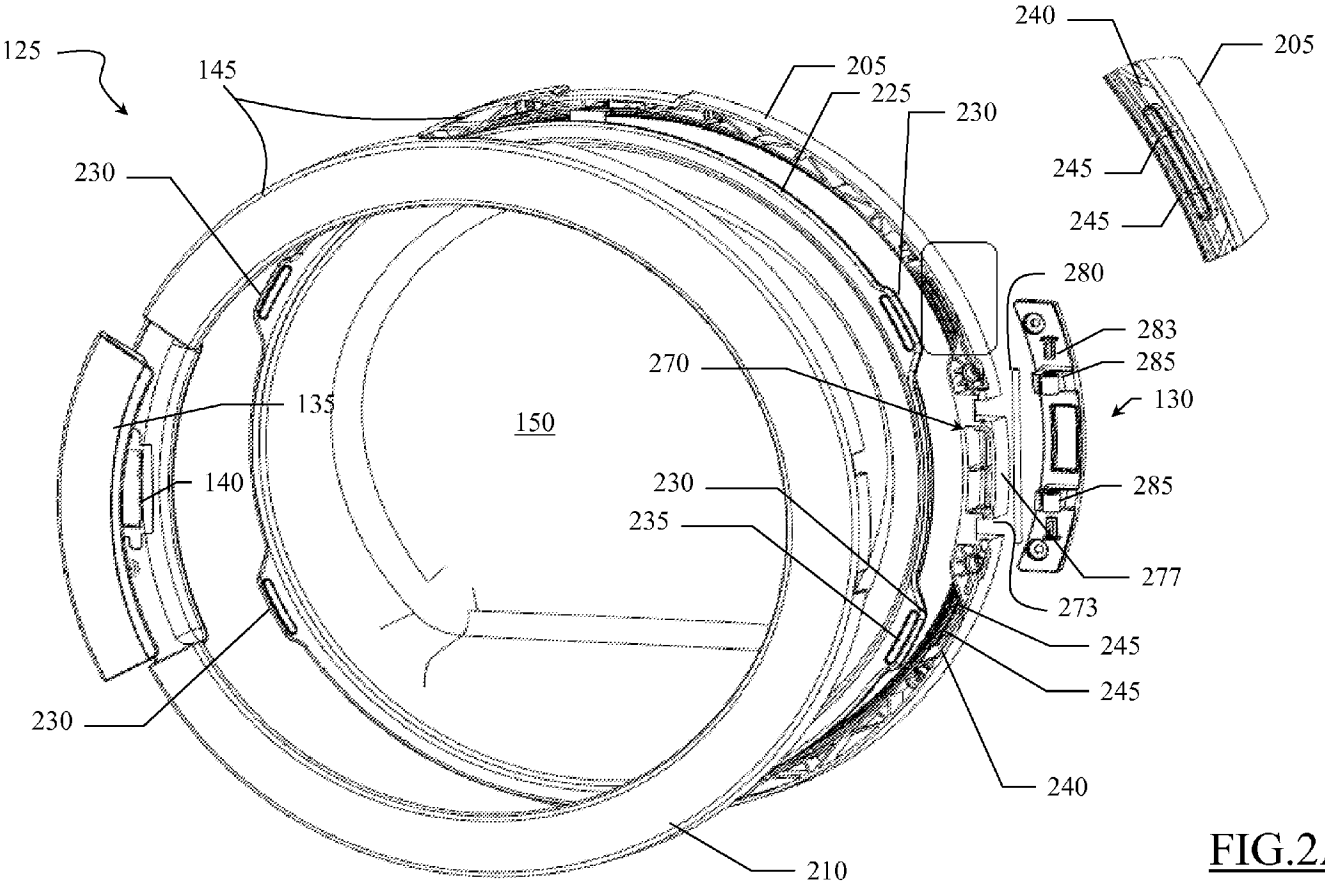
FIG. 2A is a perspective exploded view of the door of the drying machine of FIG. 1 according to an embodiment of the present invention.
Figure 2B:
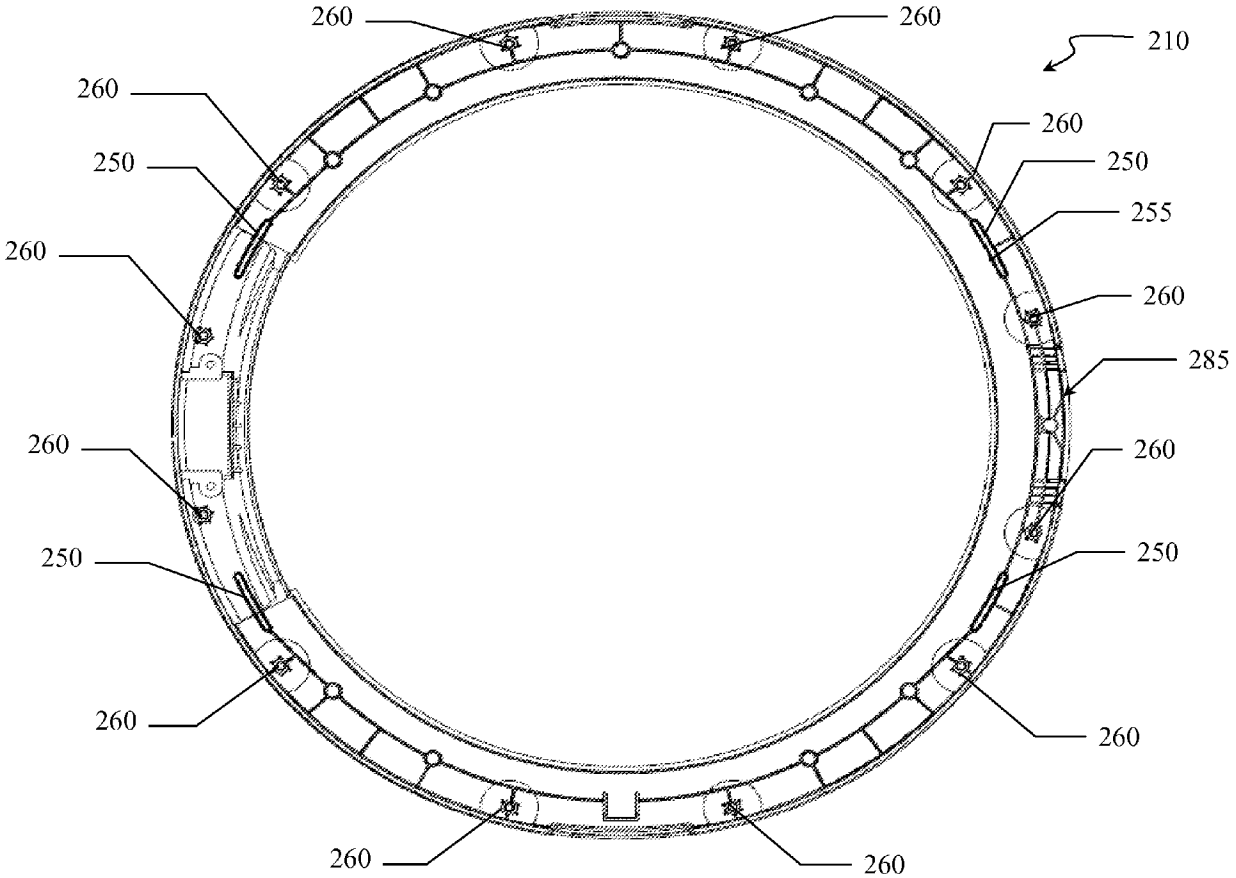
FIG. 2B is a view from behind of the outer frame of the door of FIG. 2A according to an embodiment of the present invention.

Analogously, the inner side of the outer frame 210 includes, as shown in FIG. 2B, corresponding portions 250 having respective retaining ribs 255, the latter being analogous to the retaining ribs 245, possibly with a different arrangement; such retaining ribs 255 are adapted to engage the front-side seats 235 of the wings 230 when the outer frame 210 is mounted to the glass porthole window 150.

Figure 2C:
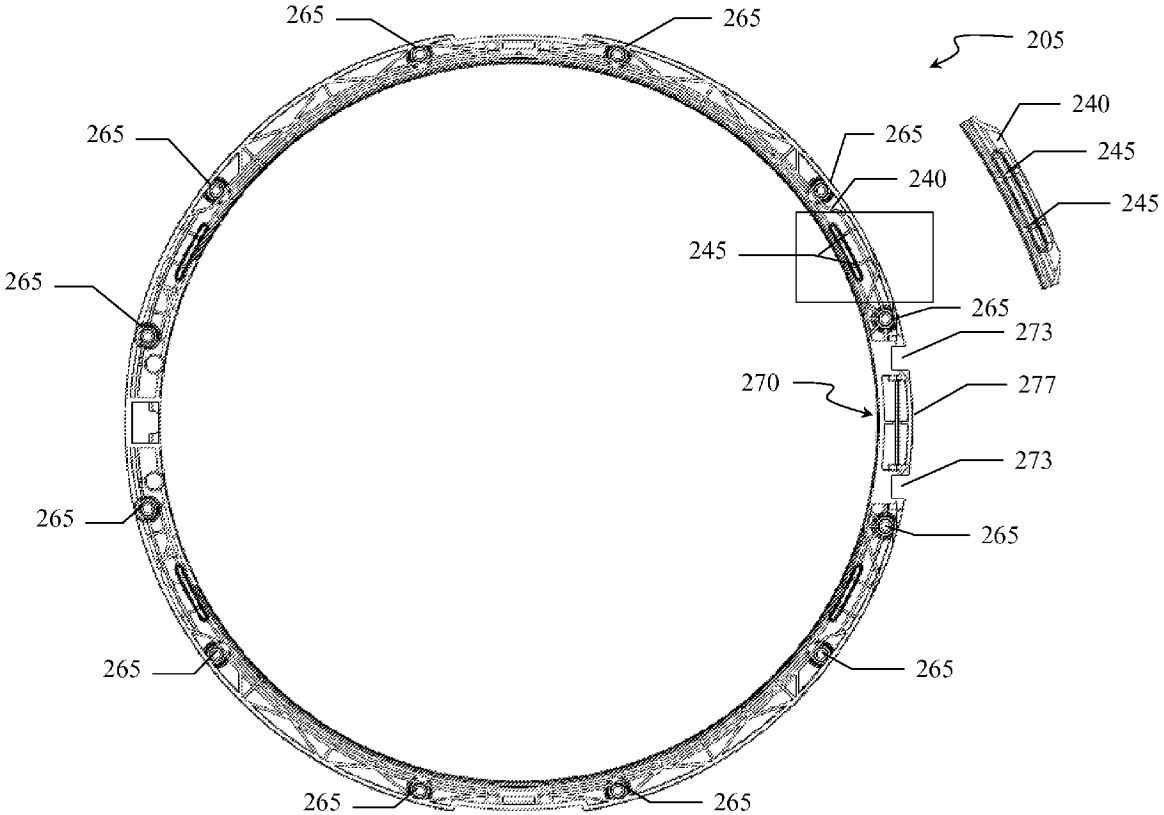
FIG. 2C is a front view of the of the inner frame of the door of FIG. 2A according to an embodiment of the present invention.

With reference now jointly to FIG. 2A, FIG. 2B and FIG. 2C, the latter representing a front view of the inner frame 205, the outer frame 210 includes a plurality of pins 260 intended to be inserted into corresponding engaging holes 265 of the inner frame 205, thereby implementing a snap-fit engagement of the inner frame 205, the outer frame 210 and the glass porthole window 150 in-between; in the structure thus obtained, the glass porthole window 150 is firmly tightened between the inner frame 205 and the outer frame 210, and at the same time the snap-fit engagement ensures a quick and easy assembly of the door 125 during the manufacturing, thereby involving production costs reductions, and an equally quick and easy disassembly of the door 125 in case of possible components replacements (or the like). In alternative embodiments, the plurality of pins 260 and the corresponding engaging holes 265 may be conveniently replaced by corresponding threaded holes (not shown in the figure) in order to enable the coupling of the glass porthole window 150 with the frames 205, 210 by means of screws.

The inner frame 205 is shaped so as to define a counter-hinge 270, which comprises recesses 273 for accommodating bushes 275 of the door hinge 130, and a pin retaining portion 277 having a slot for housing a hinge pin 280 of the door hinge 130; the hinge pin 280 is intended to be housed into the retaining portion 277 of the counter-hinge 270 and inserted into the bushes 275 for blocking them to the counter-hinge 270 (and hence to the inner frame 205). Plugs 283 of the door hinge 130 are inserted on the free ends of the hinge pin 280 for preventing it from axially sliding out.

Accordingly, the outer frame 210 includes, in correspondence of the respective portion intended to match the portion of the inner frame 205 coupled to the door hinge 130, a shaping defining respective recesses 285 for covering the bushes 275, and for covering the pin retaining portion 277 housing the hinge pin 280.

Figure 2D:
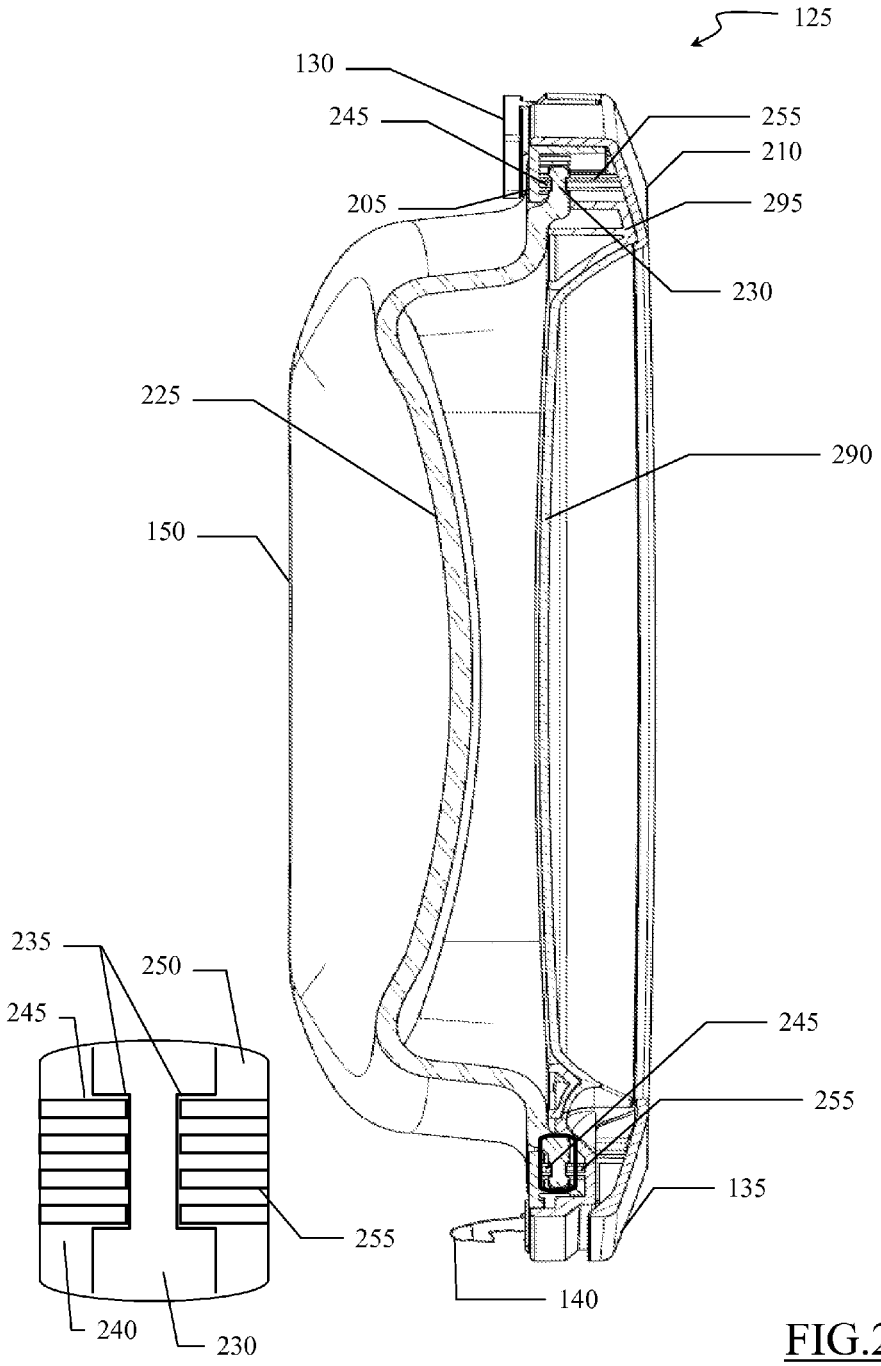
FIG. 2D is a sectional view of the drying machine door of FIG. 1 along the IID-IID axis, according to the embodiment disclosed in FIGS. 2A-2C.

As visible in cross-sectional view in FIG. 2D, the wings 230 of the border portion 225 of the glass porthole window 150 match the respective portions 250 of the outer frame 210 and the corresponding portions 240 of the inner frame 205, by engaging the retaining ribs 245, 255, respectively.

Thanks to the glass porthole window 150 structure, the door 125 exhibits an improved rigidity and stability with respect to the known washing/drying machine doors; in fact, the retaining ribs 245, 255, acting on both the front and rear side of the seats 235 of said wings 230, firmly block the glass porthole window 150 therebetween, thereby ensuring to the door 125 a high performance in terms of stability and rigidity, and finally a robustness, resistance and security thereof. Moreover, being that the rigidity of the glass forming the porthole window 150 is higher than the rigidity of the inner frame 205 and outer frame 210, the wings 230, made of glass too, transmit their rigidity also to the frame 145 surrounding the porthole window 150, thus involving a further increased strength assembly of the door 125.

As also visible in FIG. 2D, a protection cover 290 is preferably provided for covering substantially the whole surface of the glass porthole window 150; the protection cover 290 is preferably made of any transparent plastic material showing suitable heat resistance properties and low heat transmission coefficients in at least most of the operating conditions of the drying machine; in this way, the protection cover 290 can prevent burning accidents coming from any involuntarily direct contact by users of the exposed surface of the glass porthole window 150 (which becomes warm during the operation of the drying machine).

Moreover, a further annular frame 295, for example in plastic material, is provided between the transparent protection cover 290 and the glass porthole window 150, mainly for aesthetical options; in particular, the annular frame 295 allows hiding non aesthetical components (such as screws, if provided, holes, and the like).

Figure 3A:
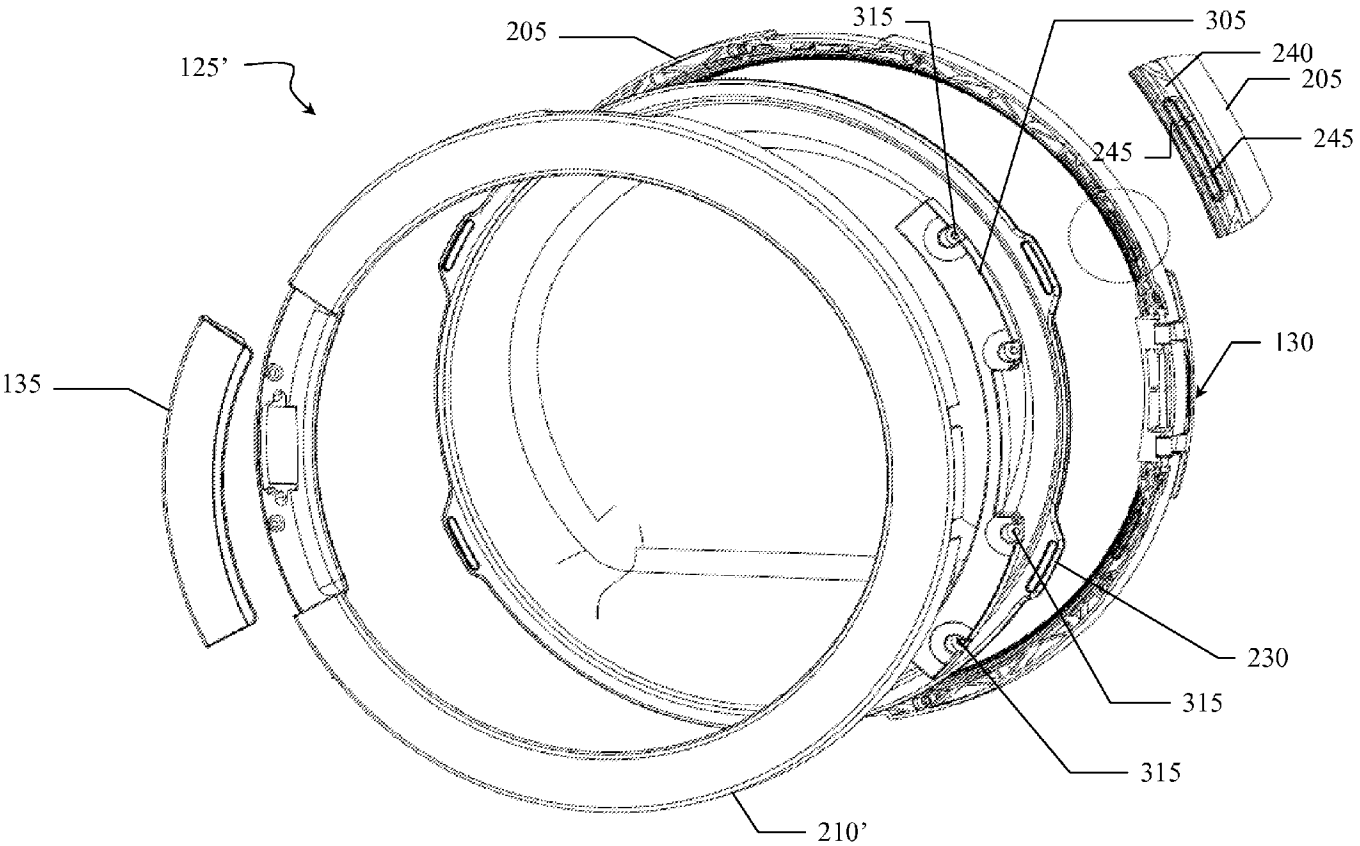
FIG. 3A is a perspective exploded view of the door of the drying machine of FIG. 1 according to another embodiment of the present invention.
Figure 3B:
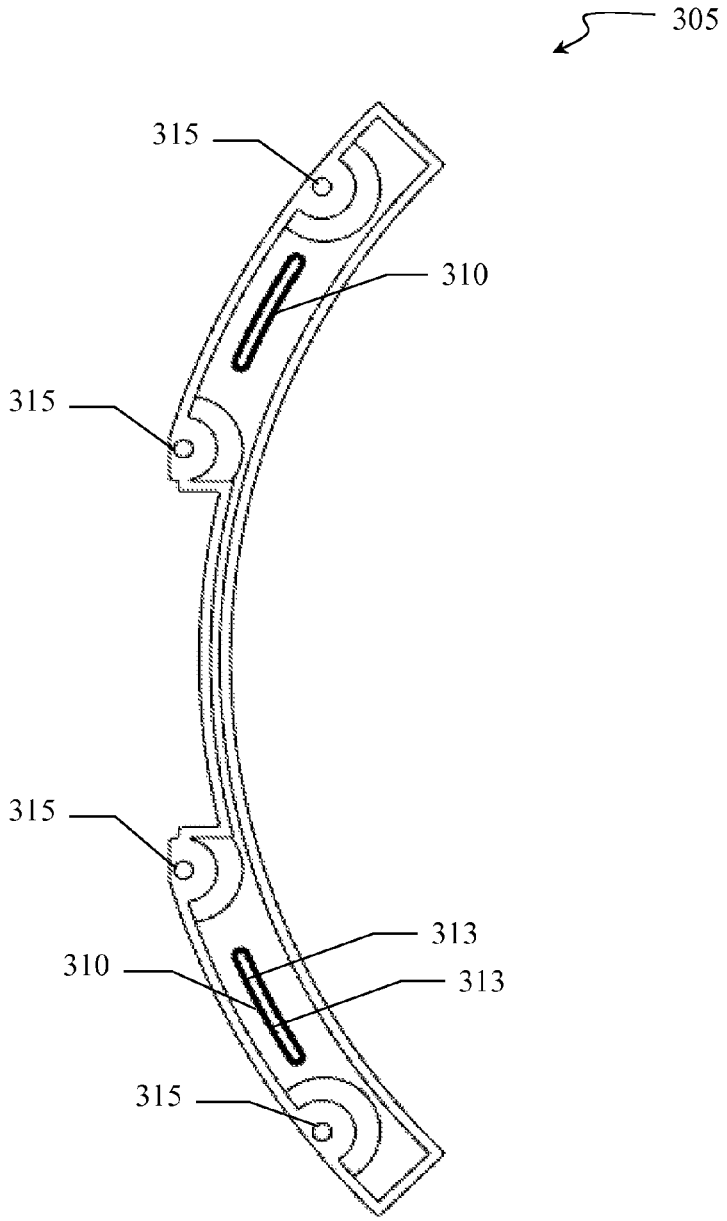
FIG. 3B is a detail of the drying machine door of FIG. 3A.
Figure 3C:
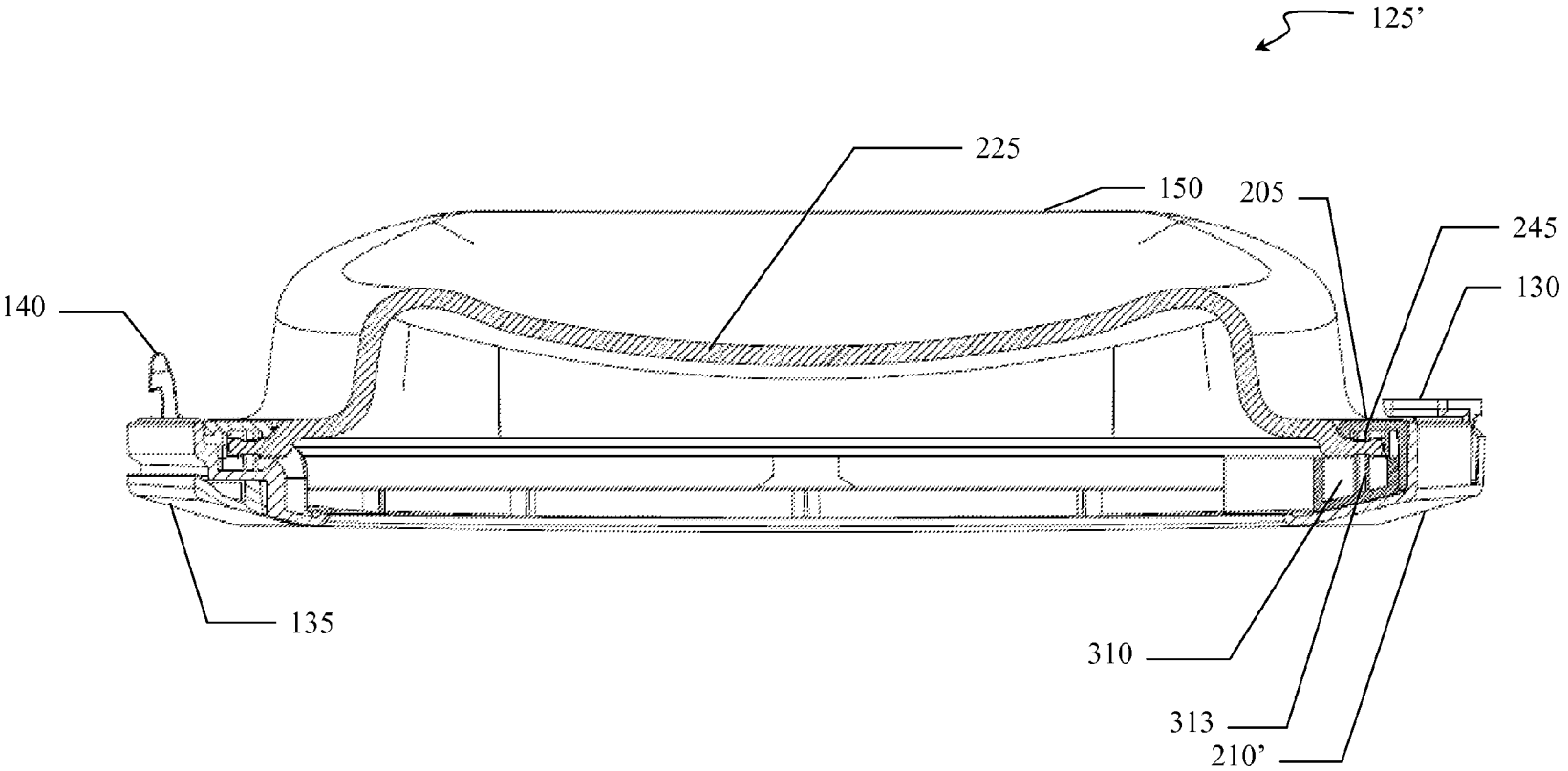
FIG. 3C is a sectional view similar to the view of FIG. 2D of the drying machine door of FIG. 1 according to the embodiment disclosed in FIGS. 3A-3B.

Another embodiment of the present invention is shown in FIGS. 3A-3C. FIG. 3A depicts in exploded view a door 125'; the door 125' is similar to the door 125 shown in FIG. 2A, with the differences that the door 125' includes an arc-shaped insert 305, made of a rigid plastic material, for example glass-filled nylon. The insert 305 is inserted between the glass porthole window 150 and a door outer frame 210' in correspondence with the door hinge 130; the insert 305 comprises at an inner surface thereof (intended to face the inner frame 205) respective matching portions 310 (or simply portions, quite similar to the portions 250 of the outer frame 210 of FIGS. 2A-2D and visible in FIG. 3B) for matching the wings 230 of the glass porthole window 150 proximate to the door hinge 130, and threaded holes 315 at the sides of each portion 310 for screwing the insert 305 to the inner frame 205 and firmly blocking the glass porthole window 150 therebetween. Possibly, the portions 310 include retaining ribs 313 analogous to the retaining ribs 245 of the portions of the inner frame 205, as described for the retaining ribs 255 of the portions of the outer frame 210 of the previously described embodiment. The provision of the insert 305 in correspondence with the door hinge, which is the region of the door more subject to stress, allows making the outer frame 210' less robust, because the stresses which, in the previous embodiment, were sustained by the outer frame 210 are now to a great extent sustained by the insert 305; in such way, the outer frame 210' of the door 125' may be conveniently different, or simpler, with respect to the outer frame 210; in particular, the outer frame 210', not requiring the portions for matching the wings 230 close to the door hinge 130, may have a less complex structure, and its material need not be particularly resistant, all this resulting in a manufacturing simplicity and thus in cost reduction.

It should be pointed out that, even if in the figure only one insert 305 is shown, this is not intended in a limitative way; in fact, since the disclosed exemplary insert 305 is configured for housing and supporting the wings 230 that are arranged close to the door hinge 130, another embodiment (not shown) may provide for at least another insert to be associated to the (two or more) other wings 230 possibly made in the border portion 225 of the glass porthole window 150.

Once screwed the insert 305 to the inner frame 205 for fixing the wings 230 (and thus the glass porthole window 150) therebetween, the outer frame 210' may be snap-fitted to the inner frame 205, in a similar, or even easier way as described in the foregoing.

The result of the described assembly is shown in cross sectional view in FIG. 3C. The use of the insert 305 allows obtaining a more robust door assembly with respect to the previously described embodiment; in fact, as known, a critical aspect for the door of every household appliance is the robustness and stability in correspondence of its hinge, where stresses are mainly sustained.

Figure 4A:
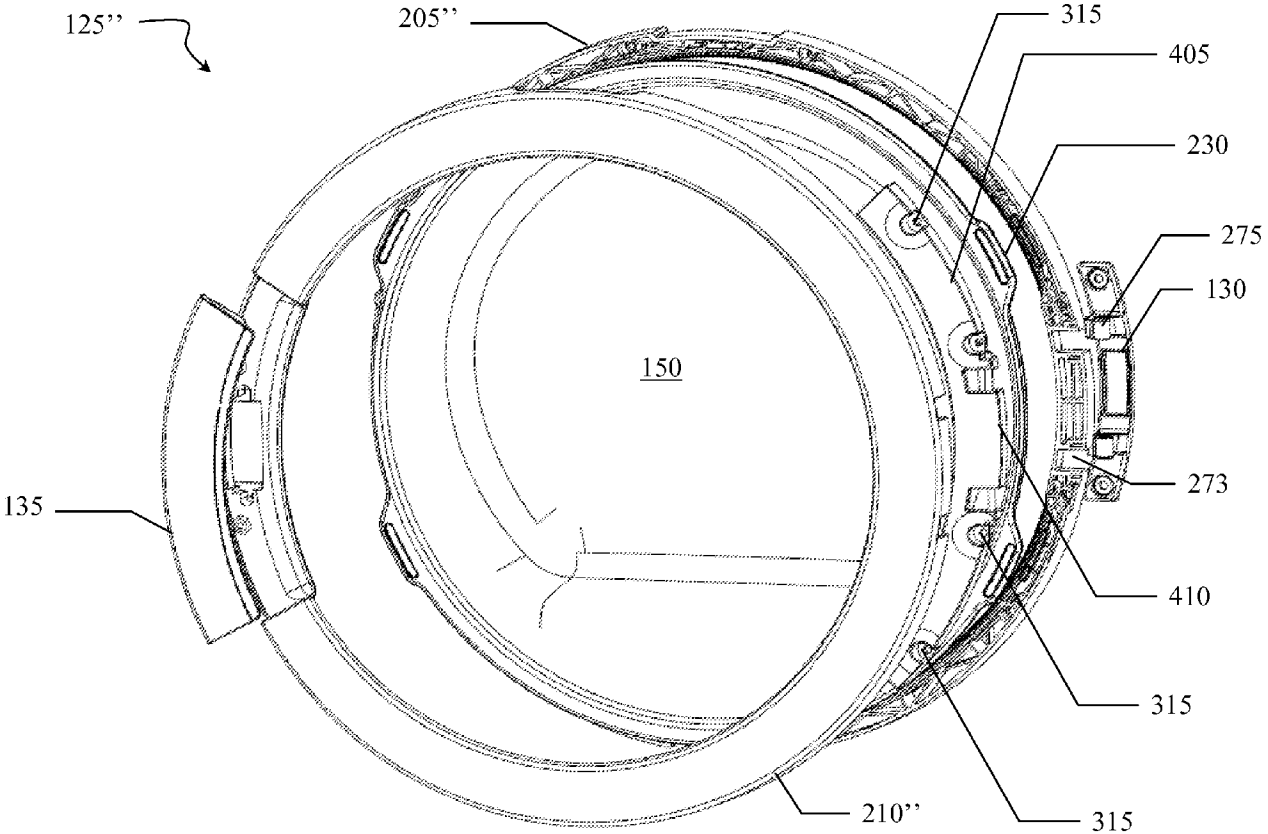
FIG. 4A is a perspective exploded view of the door of the drying machine of FIG. 1 according to a still further embodiment of the present invention.
Figure 4B:
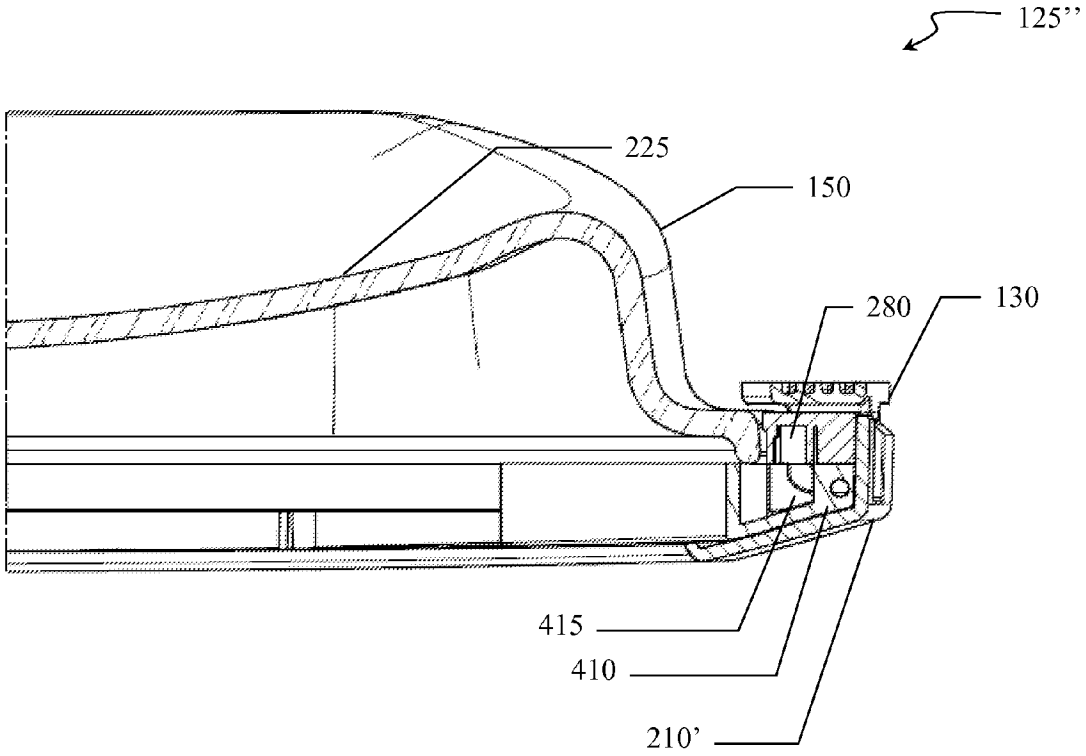
FIG. 4B is a partial view in section similar to the view of FIG. 2D of the drying machine door of FIG. 1 according to the embodiment disclosed in FIG. 4A.

A door 125" according to a further embodiment of the present invention is depicted in FIGS. 4A and 4B. In this embodiment, similarly to the previous embodiment, an insert 405 is provided, but in this case, differently from the insert 305 of the previous embodiment, the insert 405 is shaped so as to further comprise a counter-hinge 410, replacing the counter-hinge 270 that, in the two previous embodiments, was formed in the inner frame 205; in particular, also in this case the inner frame 205" comprises the recesses 273 for accommodating the bushes 275 of the door hinge 130, but the hinge pin 280 (visible in FIG. 4B) is now inserted into a corresponding pin retaining portion 415 of the counter-hinge 410 formed in the insert 405 (the pin retaining portion of the counter-hinge 410 is visible in the drawings, and it is analogous to the retaining portion 277 of the counter-hinge 270). Accordingly, a door outer frame 210" may be conveniently different from the shown and described outer frames 210, 210' of the previous embodiments; in particular, since the counter-hinge 410 is made directly on the insert 405 (i.e., in this embodiment the counter-hinge function is accomplished by the insert 405 in place of the outer frame 210" as described for the previous embodiments), the outer frame 210", with respect to the outer frames 210, 210', does not need the pin retaining portion for accommodating and holding the hinge pin 280 of the door hinge 130; this implies a very simple structure for the outer frame 210", thereby involving a manufacturing simplicity (and thus a cost reduction) for the manufacturer, and greater satisfaction in terms of quality and costs for the user. Preferably, the inner frame 205" and the insert 405 are provided with the corresponding portions 240 and 310 having the respective retaining ribs 245 and 313 for engaging the seat 235 formed on the wings 230, thus involving a very effective door assembly, as previously described. In addition to that, the overall quality of the drying machine door has been further improved; in fact, in such embodiment the door hinge 130 not only directly constrains the inner frame 205", but also it is connected to the insert 405 in a stable and direct way, thereby causing the glass porthole window 150 to be substantially integral with the inner frame 205" once the door 125" is assembled.

Therefore, a more effective hinging is obtained, which implies an improvement in weights and force distributions on the door hinge 130. Finally, such solution, in combination with the principles of the present invention greatly increases the performance and life-time of the drying machine door.

Figure 5:
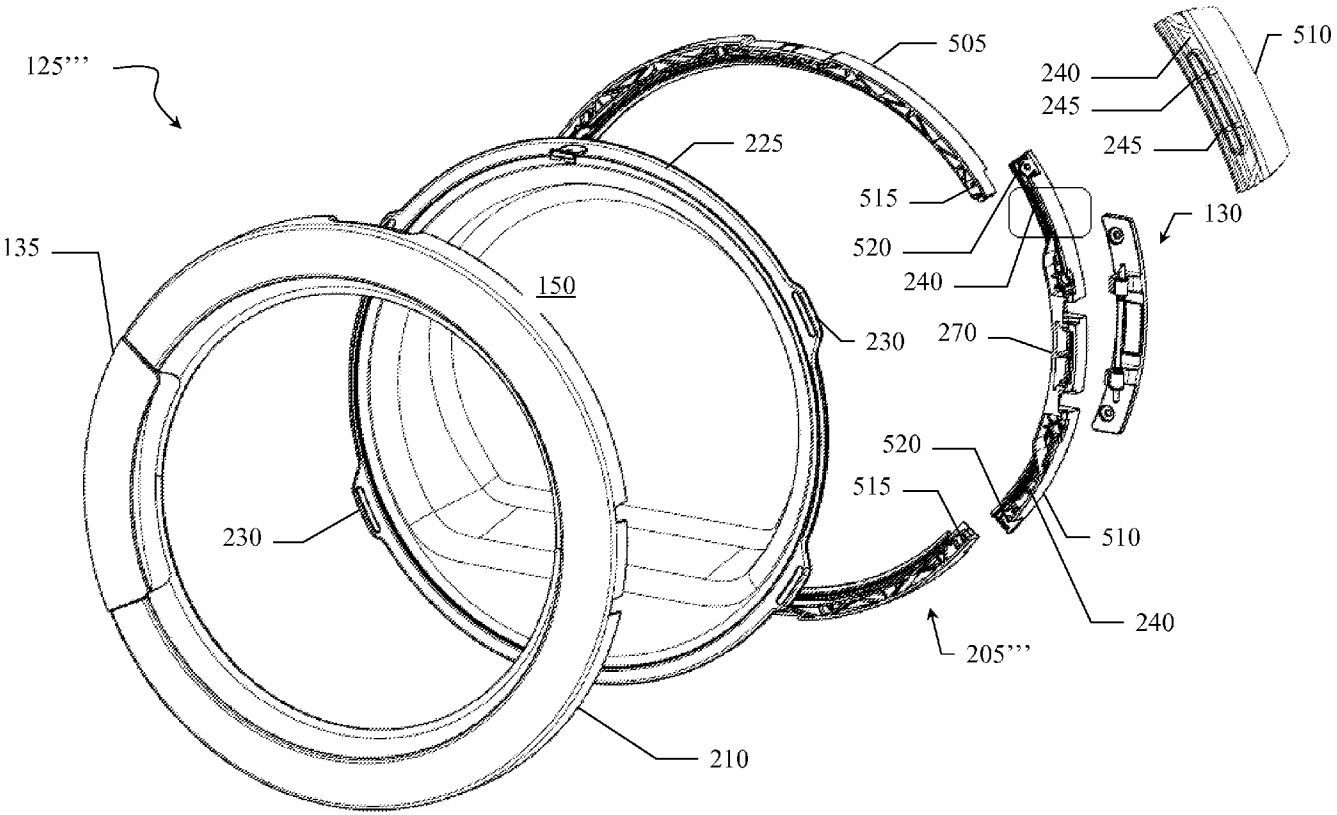
FIG. 5 is a perspective exploded view of the door of the drying machine of FIG. 1 according to still another embodiment of the present invention.

Other solutions, preferably but not necessarily in combination with the embodiments previously described, may be provided for improving the quality of the firmness and stability of the glass porthole window 150, as exemplary and schematically shown in the exploded view of FIG. 5; in particular, in such figure there is shown a door 125'" according to another embodiment of the present invention. The door 125'" includes the outer frame 210 for front covering the glass porthole window 150 as for the embodiment shown in FIG. 2A, but, differently from the latter, the door includes an inner frame 205'" that is structurally conceived for firmly holding the glass porthole window 150 in a fixed and stable position for very long periods of use. In fact, the inner frame 205'" now includes a C-shaped portion 505 structurally and functionally similar to the inner frame 205, and an arc-shaped portion 510 including the counter-hinge 270 for the hinge 130 and the portions 240 (two in the exemplary embodiment shown in the figure) for matching corresponding wings 230 of the glass porthole window 150. The arc-shaped portion 510 is preferably made of plastic compounds having compactness and rigidness higher than those of glass-filled nylon or polypropylene. The C-shaped portion 505 and the arc-shaped portion 510 have complementary shapes to each other; in particular, by engaging the C-shaped portion 505 with the arc-shaped portion 510 through screws (not shown) into corresponding holes 515 and 520, respectively, the inner frame 205'" is obtained; such inner frame 205'" has the same annular shape of the inner frame 205, 205' and 205'", but differently from the latter it exhibits two regions (the C-shaped portion 505 and the arc-shaped portion 510) having consistencies corresponding to respective tasks to be accomplished. In fact, if the inner frame 205'" is formed with enough compactness and rigidness, only the arc-shaped portion 510 may be provided with the portions 240 for housing the wings 230, while the C-shaped portion may be used for only, or above all, aesthetic purposes; in this way, the glass porthole window 150 may also be provided with a lower number of wings 230 arranged on its border portion 225, thus involving a cost reduction (for manufacturing the glass porthole window 150) that compensates possible cost increases for manufacturing the inner frame 205'" having improved rigidity and compactness qualities; therefore, drying machines (and/or washing appliances) having the door 125'" or any other door making use of the improved inner frame 205'" ensure high performance in terms of quality and lifetime, at substantially unchanged production costs. Obviously, for economic or performance reasons, also the outer frame 210 may include different parts having corresponding rigidities properties.

As it will be clearly understood, among the embodiments above disclosed, the one to chose is not obvious and depends on logistic, economic and design considerations by the manufacturer and on user requests. However, without distinction for which one of the implementations is conveniently chosen for a certain application, the present invention is particularly advantageous since it allows ensuring a better coupling between the glass porthole window and the frames forming the access door for the drying machine; in particular, the improved fixing of the porthole window into the frames shown in each one of the embodiments disclosed in the foregoing allows making the drying machine door substantially unaffected by any sliding of the porthole with respect to the frames, both for natural sliding due to its own weight and for the vibrations caused by most of the operations performed by the drying machine during a drying cycle. For such reason, the present invention allows providing drying machines (or any similar household or industrial appliance) having long-lasting doors also in case of intensive use of the same.

In order to satisfy local and specific requirements, a person skilled in the art may apply to the solution described above many commonsensical and/or physical modifications and alterations. More specifically, although the present invention has been described with a certain degree of particularity with reference to a preferred embodiment thereof, it should be understood that various omissions, substitutions and changes in the form and details as well as other embodiments are possible; moreover, it is expressly intended that specific elements and/or method steps described in connection with any disclosed embodiment of the invention may be incorporated in any other embodiment as a matter of general design choice.

For example, similar considerations apply if the drying machine and/or the door have a different structure or include equivalent components (either separated or combined together, in whole or in part); in particular, it is possible to provide any number (one or more) of inner and/or outer support frames for aesthetical or practical options. Moreover, the receiving regions may not be provided in the form of wings; in general, the receiving regions, only exemplarily in the form of wings, may have any shape and/or size according to particular and specific design, economic and/or aesthetic requirements.

Furthermore, the portions (or any other type of receiving region) may have any shape or size; at the limit, they may be shaped and sized in such a way that a snap-fit coupling may be implemented in place of a simple housing of the wings within the corresponding portions.

The front and/or rear seats of the wings may also not be provided, or replaced with functionally equivalent components, such as for example suitable holes (conveniently formed along the border portion) within which to insert the ribs, or functionally similar components, of the portions. Moreover, the wings may also be omitted, depending on specific requests for the glass porthole window, and the same tasks accomplished by the receiving regions may be equivalently performed through other equivalent elements; in particular, for all the embodiments disclosed in the foregoing, the glass porthole window may equivalently include a regular circumferential edge (in place of the irregular border portion-protruding wings structure) wherein the front and/or the rear seats may be directly provided on at least some sectors thereof. Moreover, the regular circumferential edge with the provision of the seats may replace the border portion-protruding wings structure, or even only the protruding wings along the border portion.

The number and the shape of the inserts is not limitative for the present invention; in particular, each insert may conveniently be used for supporting only one wing, thereby making easier a possible replacement thereof. Moreover, the threaded holes of the insert may also not be provided, and replaced, for example, by suitable coupling members for implementing a snap-fit engagement of the insert with the inner frame.

Also the shape of the porthole window is not limitative for the present invention; in particular, the porthole window may have a flat shape, particularly advantageous in terms of costs and manufacturing facility if the outer casing of the drying machine is shaped in such a way that a dead space between the drum of the drying machine and the outer casing is avoided.

The porthole window may be made of glass, plastic materials having heat resistance properties, or a combination thereof, depending on the quality, the transparency level and the weight that it is wanted to obtain for the door.

Although in the present description explicit reference has been made to front-loading drying machines, it is clear that any household or industrial appliance requiring very effective doors may be provided with the door according to the present invention.

Furthermore, the solution according to an embodiment of the invention lends itself to be implemented by an equivalent method (by using similar steps, removing some steps being not essential, or adding further optional steps); moreover, the steps may be performed in different order, concurrently or in an interleaved way (at least partly).

The invention claimed is:

1. A door for a laundry washing and/or drying appliance, the door including:

a door inner frame, a door outer frame, and a transparent porthole window having a border portion fitted between the inner frame and the outer frame, wherein:

the border portion of the porthole window has at least one receiving region having, at least on one side thereof facing the inner frame or the outer frame, a seat forming a cavity in the receiving region, and in that at least the inner frame or the outer frame has, in a portion corresponding to the receiving region of the porthole window, at least one rib fitting into the seat of the receiving region;

at least the inner frame or the outer frame includes at least one inner portion or outer portion, respectively, for matching with the at least one receiving region;

the at least one rib is provided within said at least one inner portion and/or outer portion; and the at least one inner portion comprises a plurality of corresponding ribs and the at least one outer portion comprises a plurality of corresponding ribs, the ribs of the at least one inner portion being configured to engage a rear seat of the at least one receiving region, the ribs of the at least one outer portion being configured to engage a front seat of the receiving region.

2. The door according to claim 1, further including at least one insert configured to be fitted between the inner frame and the porthole window in correspondence with at least a part of the border portion, the at least one insert comprising at least one matching portion so as to match with the at least one receiving region between the at least one matching portion and the corresponding at least one inner portion.

3. The door according to claim 2, wherein the at least one insert further includes threaded holes arranged at the sides of the at least one matching portion so as to perform said fitting of the at least one insert with the inner frame by a screwing operation.

4. The door according to claim 3, wherein the insert further includes a counter-hinge for enabling a hinging of an assembly of the inner frame-porthole window-insert so as to increase a stability and a life-time of a hinge of the door.

5. The door according to claim 2, wherein the matching portion and/or the at least one inner portion include/includes corresponding ribs for holding the seat of the at least one receiving region.

6. The door according to claim 5, wherein the insert further includes a counter-hinge for enabling a hinging of an assembly of the inner frame-porthole window-insert so as to increase a stability and a life-time of a hinge of the door.

7. The door according to claim 2, wherein the insert further includes a counter-hinge for enabling a hinging of an assembly of the inner frame-porthole window-insert so as to increase a stability and a life-time of a hinge of the door.

8. The door according to claim 2, wherein the at least one insert includes a composite material such as glass-filled nylon.

9. The door according to claim 1, wherein the porthole window is a bowl-like porthole window extending inwards towards the interior of the appliance when the door is in a closed configuration.

10. The door according to claim 1, wherein the porthole window is made of glass.

11. The door according to claim 1, wherein at least part of the inner frame or the outer frame includes a composite thermoplastic material such as glass-filled nylon or a plastic compound such as glass-filled poly-propylene or talc-filled poly-propylene.

12. The door according to claim 1, wherein the at least one receiving region includes at least one wing protruding from the border portion of the porthole window.

13. A front-loading drum-type laundry drying appliance comprising a door according to claim 1.

* * * * *